US006086286A

United States Patent [19]

Loarie et al.

[11] Patent Number: 6,086,286

[45] Date of Patent: Jul. 11, 2000

[54] WALKWAY ABUSE DETERRENT SYSTEM

[75] Inventors: Christopher T. Loarie, La Mesa; Michael J. Loarie, Escondido, both of Calif.

[73] Assignee: Intellicept, San Diego, Calif.

[21] Appl. No.: 09/122,242

[22] Filed: Jul. 24, 1998

[51] Int. Cl.[7] ..... E01C 11/22

[52] U.S. Cl. ..... 404/7; 404/8; 206/453

[58] Field of Search ..... 404/6, 7, 8, 9, 404/14, 15, 16, 19; 206/453; D8/403

[56] References Cited

U.S. PATENT DOCUMENTS

| | | | |
|---|---|---|---|
| 355,810 | 1/1887 | Brown | 404/7 |
| 1,066,196 | 7/1913 | Fixmer | 404/8 |
| 1,479,651 | 1/1924 | Clements | 404/6 |
| 1,961,227 | 6/1934 | Klick | 404/8 |
| 2,935,162 | 5/1960 | Lindsay | 404/6 |
| 4,554,616 | 11/1985 | McIntosh | 361/816 |
| 4,582,739 | 4/1986 | Givens | 428/83 |
| 4,813,811 | 3/1989 | Adams . | |
| 4,877,673 | 10/1989 | Eckel et al. | 428/172 |
| 5,310,279 | 5/1994 | Lindner . | |
| 5,639,072 | 6/1997 | McCall . | |
| 5,657,955 | 8/1997 | Adams . | |

FOREIGN PATENT DOCUMENTS

| | | | |
|---|---|---|---|
| 423097 | 1/1935 | United Kingdom | 404/8 |
| 480927 | 3/1938 | United Kingdom | 404/8 |
| 511711 | 8/1939 | United Kingdom | 404/7 |

*Primary Examiner*—James A. Lisehora
*Attorney, Agent, or Firm*—Stout, Uxa Buyan & Mullins; Frank J. Uxa

[57] ABSTRACT

A system for inhibiting a wheeled, personal mobility unit, such as skateboards and in-line skates, from sliding along a surface having two or more surface portions oriented at mutually different angles has at least one part having a contact surface that generally complements the two or more surface portions of the surface. The part also has a body extending from the contact surface and terminating at an exposed surface. The part may have hinges to enable the part to bend and conform to complement the surface. The part may have three dimensional features extending from the contact surface for increased adhesive contact area relative to a flat contact surface. The contact surface of the part may be attached by adhesion or other methods to the surface.

12 Claims, 3 Drawing Sheets

Fig. 5
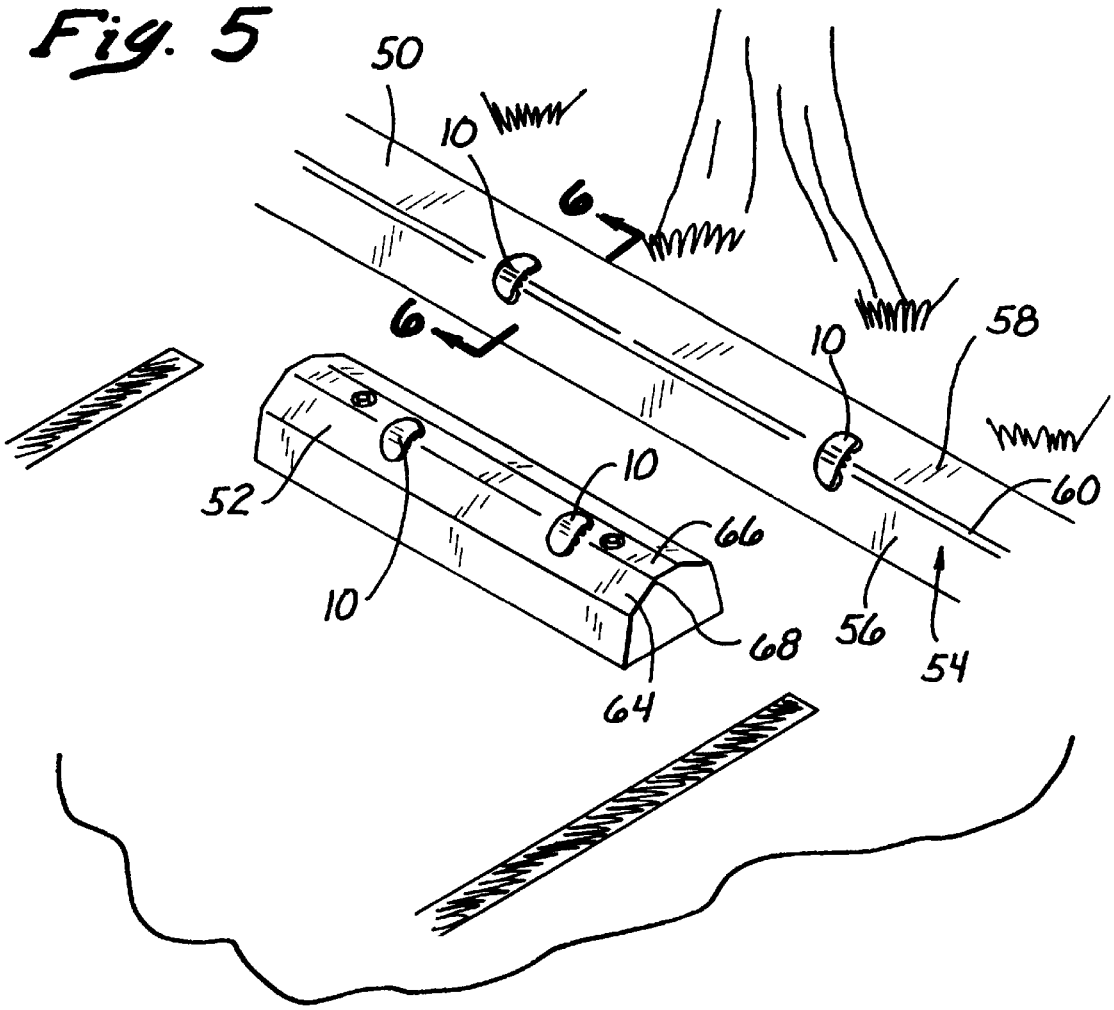
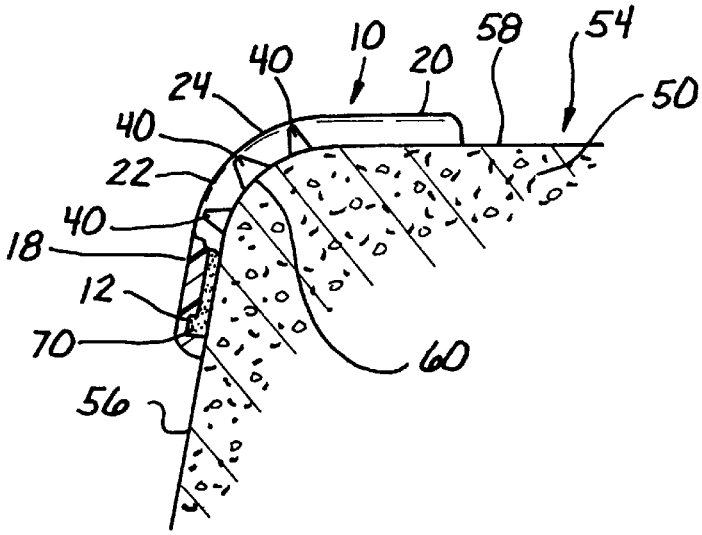
Fig. 6

WALKWAY ABUSE DETERRENT SYSTEM

BACKGROUND OF THE INVENTION

1. Field of the Invention

This invention relates generally to inhibiting defacement of curbs, rails, benches and other walkway features and, more particularly, to inhibiting, for example, a wheeled, personal mobility unit, such as a skateboard or in-line skate, from sliding or grinding over such walkway features and the like surfaces.

2. Description of the Related Art

The popularity of skateboarding, in-line skating, and other activities that use wheeled, personal mobility units has increased, and continues to increase. Professional, televised competitions, along with personal appearances and shows by expert skateboarders and in-line skaters abound. Recreational parks specially built for these activities provide controlled yet challenging areas for the practitioners of these activities.

Not all skateboarders and in-line skaters practice their sport in ways that are respectful of people or property. The general public, as well as local merchants, church officials, school administrators, and public administrators, have complained regarding the behavior of skate boarders and skaters in the community. Some of the complaints concerned the skateboarders and skaters using the curbs, benches, and sidewalk edges to practice and perfect stunts. As a result, the general tranquility was disturbed, property owners endured real property damage, local merchants observed reduced customer traffic, and concern was expressed with a perceived increase in liability associated with personal injury and/or property damage.

A stunt commonly performed by skateboarders and in-line skaters is to slide or grind along non-planar or multi-angled surfaces, such as curb edges, park bench edges, and handrails. A general solution to the problem is to interrupt the surfaces that are the target for sliding.

A specific solution in the prior art concerning sliding along curb edges involves placing additional curbs in a zig-zag pattern along the curb edge. The apexes on one side of the zig-zagged additional curbs form a line that is parallel to the curb edge, but the apexes are only near the edge and not co-extensive with the edge. This arrangement results in insufficient area about the curb edge for sliding. However, the placement of the additional curbs is expensive, bulky, and unattractive.

A specific solution in the prior art concerning sliding along bench edges places disc-like units on the horizontal surface of the bench. The disc-like units are placed in a row parallel to the bench edge, but the row is only near the edge and not co-extensive with the edge. Again, this arrangement results in insufficient area about the bench edge for sliding. However, the disc-like units are appropriate for placement on planar or flat surfaces. Further, the skateboarders and in-line skaters slide along the edge and the solutions in the prior art do not directly address interrupting the sliding edge.

Therefore, a system and process for inhibiting a wheeled, personal mobility unit, such as skateboards and in-line skates, from sliding along surfaces having portions oriented at mutually different angles, for example, curb, bench and sidewalk edges, is needed.

SUMMARY OF THE INVENTION

An objective of the invention is to provide a system for inhibiting sliding or grinding along a surface having two or more surface portions oriented at mutually different angles. The present systems very effectively inhibit such activities, for example, using wheeled, personal mobility units, such as skateboards and in-line skates, which result in reduced bodily injuries and property damage, and an increase in the overall tranquility. The present systems are straightforward in design and construction, can be adapted to various surfaces and are cost effective to manufacture and use. Moreover, the systems can be used without substantially disrupting the functionality and attractiveness of the surface. In general, the present systems comprise at least one part, and often a plurality of parts, having a contact surface that generally complements, or conforms to, the two or more angled surface portions of the surface. The part also has a body, for example, a substantially incompressible body, extending from the contact surface and terminating at an exposed surface. The part preferably is permanently secured to the surface. In one embodiment, an adhesive, such as a conventional epoxy adhesive, is located adjacent the contact surface and is effective in securing the part to the surface.

In one aspect of the invention, the body includes first and second body portions joined by a hinge assembly for flexibly connecting the first and second body portions. Thus, the body is adapted to bend about the hinge assembly to conform to at least two of the surface portions. In one particularly useful embodiment, the hinge assembly comprises first and second hinges. The first hinge is flexibly connected to the first body portion. The second hinge is flexibly connected to a second body portion. The two hinges are flexibly connected or joined. The contact surface preferably extends over the body portions and the hinges. The part is flexible about the hinges thereby enabling the contact surface to conform to a multi-angled surface.

In another aspect of the invention, the part has one or more three dimensional features extending from the contact surface for providing an increased adhesive contact area relative to a flat contact surface. The part is adhered to the surface by a layer of adhesive between the contact surface and the surface.

A plurality of the parts as described elsewhere herein can be packaged and sold together. A plurality of such parts can be placed at spaced apart intervals along a surface to inhibit unwanted sliding along the surface, as described elsewhere herein.

In a further aspect of the invention, a process for inhibiting sliding along a surface having two or more surface portions oriented at mutually different angles comprises the step of providing a part that has a contact surface that generally complements the surface, such as the parts described elsewhere herein. The part is secured, preferably permanently secured, to at least one of the surface portions.

Any combination of two or more features described herein are included within the scope of the present invention provided that the features in each such combination are not mutually inconsistent.

These and other aspects and advantages of the present invention are apparent in the following detailed description and claims, particularly when considered in conjunction with the accompanying drawings in which like parts bear like reference numerals.

BRIEF DESCRIPTION OF THE DRAWINGS

FIG. 5 shows double hinged parts of shown in FIG. 1 adhered to curbs;

FIG. 6 is a sectional view of one of the double hinged parts of FIG. 5 shown conforming to complement the rounded corner of the curb;

DETAILED DESCRIPTION OF THE PREFERRED EMBODIMENTS

Figure 1:
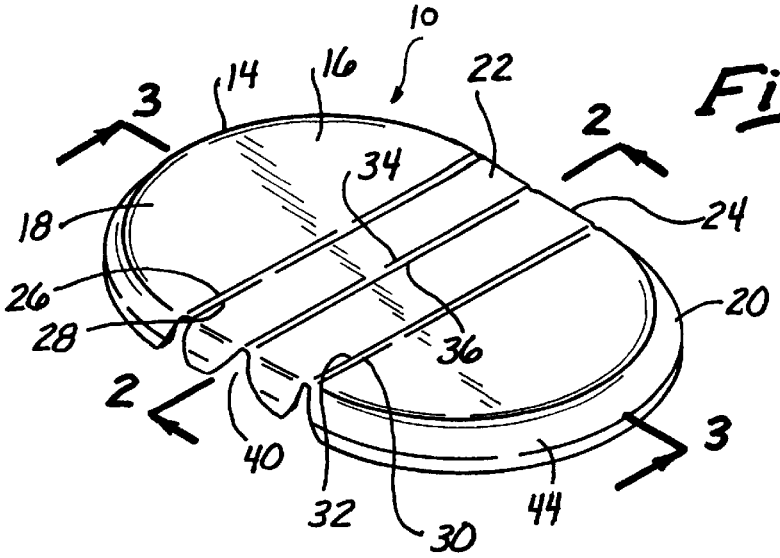
FIG. 1 is an isometric view of a double hinged part that conforms to complement a variety of surfaces having differently angled portions according to an embodiment of the invention.
Figure 4:
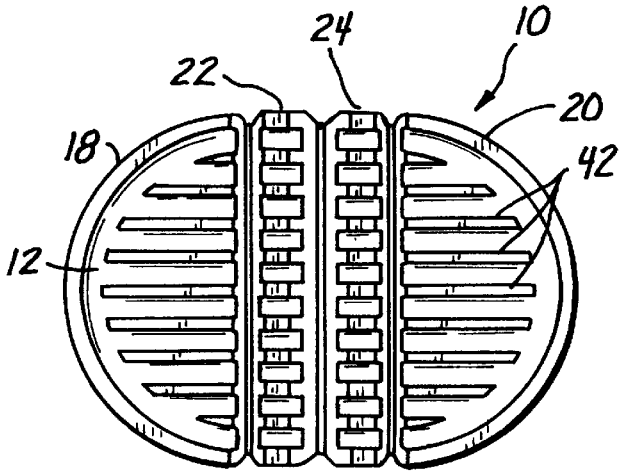
FIG. 4 is a bottom view of the double-hinged part shown in FIG. 1.
Figure 2:
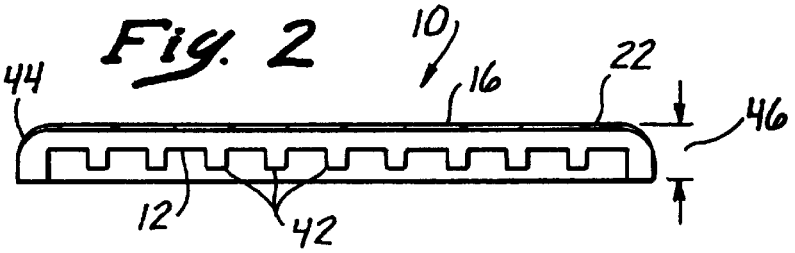
FIGS. 2 and 3 are sectional views of the double-hinged part shown in FIG. 1.
Figure 3:
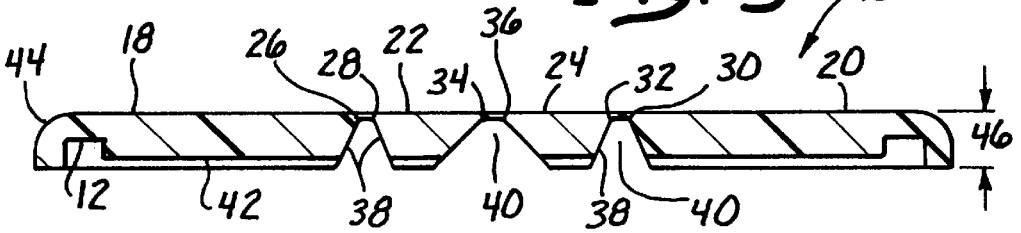

Referring now to FIGS. 1 through 4, a double hinged part 10 has an approximately oval shape, when placed in a flat position, and comprises a contact surface 12 with a body 14 extending therefrom. The body 14 terminates in an exposed surface 16. The body 14 is comprised of first and second body portions 18 and 20 with first and second hinges 22 and 24 disposed therebetween.

The body 14 may be comprised of a substantially incompressible material, such as thermoset plastic, thermoplastic polymer, hard rubber, or wood. Other embodiments of the invention may have a body 14 that is comprised of a relatively compressible material, such as a relatively soft rubber or other polymer or even a polymeric foam. In an embodiment of the invention, the body 14 is made from a unitary piece of plastic or polymeric material. Other embodiments of the invention may be assembled from multiple parts, and/or the parts may have different compositions.

The body portions 18 and 20 and the hinges 22 and 24 are flexibly attached to enable the contact surface 12 to conform to complement a variety of surfaces having differently angled portions, for example, a surface which forms an edge (see FIGS. 5 and 6). More specifically, the first body portion 18 has a first body portion hinge edge 26 that is flexibly connected to a first edge 28 of the first hinge 22. Further, the second body portion 20 has a second body portion hinge edge 30 that is flexibly connected to a first edge 32 of the second hinge 24. The first hinge 22 has a second edge 34 that opposes the first hinge first edge 28. The second hinge 24 has a second edge 36 that opposes the second hinge first edge 32. The second hinge edges 34 and 36 are flexibly connected.

The shown embodiment of the invention has two hinges 22 and 24. Other embodiments of the invention may include no hinges, one hinge or more than two hinges.

In the shown embodiment of the invention, adjacent walls 38 of the body portions 18 and 20 and the hinges 22 and 24 are beveled away from the edges 26, 28, 30, 32, 34, and 36. The adjacent walls define a v-gap 40 between the adjacent sections of the double hinged part 10. The v-gaps 40 enable the double hinged part 10 to bend about the hinges and conform to complement a surface having two or more surface portions oriented at mutually different angles or a surface having two or more angularly oriented surface portions (see FIGS. 5 and 6). Other embodiments of the invention may have only one of a pair of adjacent walls being beveled. Other embodiments of the invention may not have beveled adjacent walls, with the hinge configuration being such that the part 10 may still conform to complement a multi-angled surface.

The part 10, in the shown embodiment of the invention, comprises three dimensional features 42 extending from the contact surface 12 in a plurality of rows. The three dimensional features 42 provide an increased adhesive contact area relative to a flat contact surface, thereby improving adhesion of the part 10 to a surface (see FIG. 6). Other embodiments of the invention may have a part with three dimensional features of other shapes and configurations, or a flat contact surface.

In the shown embodiment, the flexibly attached pairs of edges 26 and 28, 30 and 32, and 34 and 36 are coextensive, but other embodiments of the invention may have pairs of edges that are not co-extensive. Further, while the shown embodiment of the invention is symmetrical about a number of axes (not shown), other embodiments of the invention may not be symmetrical and the body portions 18 and 20 and the hinges 22 and 24 may be of any suitable configuration or shape. The shown embodiment of the invention has a rounded edge 44 about the perimeter of the part 10. Other embodiments of the invention may have perimeter edges of other shapes. The shown embodiment of the invention has a relatively shallow height 46 resulting in a low profile. Other embodiments of the invention may have other heights, varying heights, and different profiles.

Referring now to FIG. 5, the double hinged parts 10 are attached to a poured curb 50 and an installed curb 52 to inhibit wheeled, personal mobility units, such as skateboards and in-lines skates, from sliding on the curbs. Referring now to FIG. 6 as well, the curb 50 has a surface 54 with two surface portions 56 and 58 oriented at different angles (approximately at a right angle to each other) that meet at a rounded corner 60. The part 10 has been bent about the hinges 22 and 24 to conform and complement the surface portions 56 and 58 and the rounded corner 60. Attention is directed to the v-gaps 40 which have narrowed with the bending of the part 10. The parts 10 are similarly attached to the installed curb 52, with the parts conforming to complement a surface 62 with two surface portions 64 and 66 oriented at different angles that meet at a relatively sharp corner 68.

In the shown embodiment of the invention, the parts 10 are attached to distinct surface portions 56, 58, 64, and 66 that meet at an angle. Other embodiments of the invention may have the surface portions being less distinct. One example of such a surface is a cylindrical rail (not shown). As such, surface portions oriented at mutually different angles or angularly oriented surface portions shall include distinct surface portions, rounded surface portions, and cylindrical surface portions for the purposes of defining the present invention.

Referring now to FIG. 6, a layer of adhesive 70 between the contact surface 12 and the curb surface 54 permanently attaches the part 10 to the curb 50. Any suitable adhesive, for example, conventional epoxy adhesives and the like, may be used to attach the part 10 to the surface 54. Other embodiments of the invention may use any other suitable assemblies or members for attaching the part 10, such as pins, nails, screws, mounting studs and the like. Other embodiments of the invention may use other less permanent means of attaching the part 10 to the surface 54. However, these less permanent means would be designed such that only designated people may remove part 10. An example of such a less permanent means is a system that employs a special tool, that is not readily available to those not authorized to remove the parts, to remove the parts (not shown).

Figure 7:
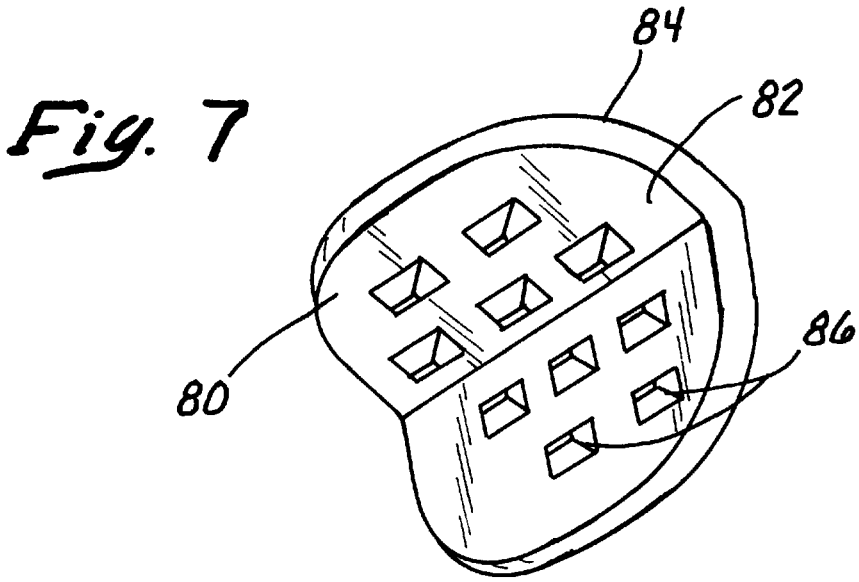
FIG. 7 is an isometric view of a solid part that complements a right angled surface according to an embodiment of the invention.

Now referring to FIG. 7, the shown embodiment of the invention is a solid part 80 with a right-angled contact surface 82. A body 84 of the part 80 extends from the contact surface 82 and terminates in a partially spherical exterior surface 84. Other embodiments of the invention may have exterior surfaces of other shapes. The part 80 has nodes 86 extending from the contact surface 82 into the body 84 for an increased adhesive contact area relative to a part with a flat contact surface. For the purposes of defining the invention, the nodes 86 extending into the body 84 are equivalent to three-dimension features extending from a contact surface. Other embodiments of the invention may have flat contact surfaces.

The body 84 may be comprised of a substantially incompressible material, such as described elsewhere herein. Other embodiments of the invention may have a body 84 that is comprised of a relatively compressible material, such as described elsewhere herein. In an embodiment of the invention, the body 84 is made from a unitary piece of plastic. Other embodiments of the invention may be assembled from multiple parts, and the parts may have different compositions.

Figure 8:
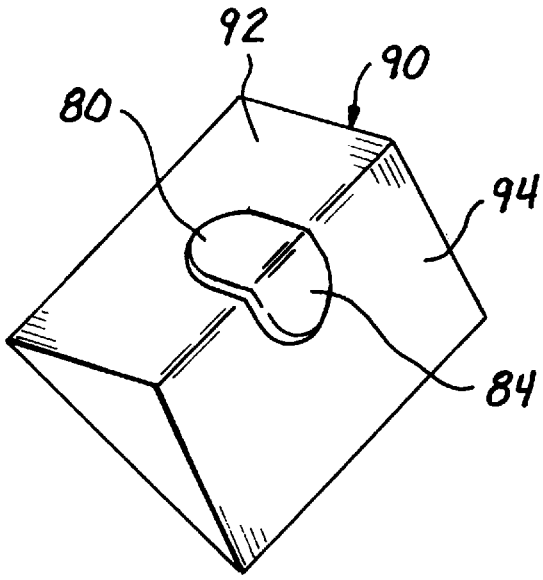
FIG. 8 is an isometric view of the solid part shown in FIG. 7 attached to a right angled surface.
Figure 9:
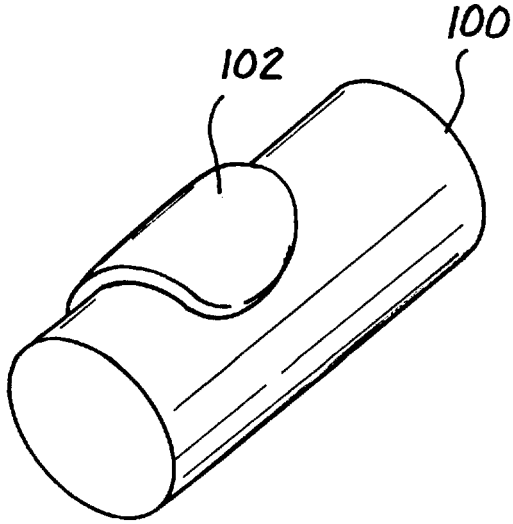
FIG. 9 is an isometric view of a solid part mounted to a cylindrically shaped surface according to an embodiment of the invention.

Referring now to FIG. 8, the solid part 80 is attached to a right-angled surface 90. The contact surface 82 of the solid part 80 complements surface portions 92 and 94 of the surface 90 as the surface portions are oriented at a right angle. Other embodiments of the invention may have parts that complement surface portions that meet at other angles or configurations. For example, in the embodiment of the invention shown in FIG. 9, the surface 100 is cylindrical. A part 102 is similar to part 80 but for the contact surface (not shown) being rounded to complement the cylindrical surface 100.

In an embodiment of the invention, a layer of adhesive (not shown) adjacent to the contact surface attaches the part 80 to the surface 90. Other embodiments of the invention may use other means for attaching the part 80 to a surface, as was previously discussed in connection with the embodiment of the invention shown in FIG. 6. In further embodiments of the invention, the connection means, whether it is adhesive or another means, may attach the part 80 to only one surface portion.

While the description above refers to particular embodiments of the present invention, it will be understood that many modifications may be made without departing from the spirit thereof. Further, aspects of the invention may have combinations of the above described embodiments although these combinations may not be explicitly described. The accompanying claims are intended to cover such embodiments as would fall within the true scope and spirit of the present invention.

What is claimed is:

1. A system for inhibiting sliding along a surface having two or more surface portions oriented at mutually different angles, the system comprising the surface having two or more surface portions oriented at mutually different angles and being susceptible to sliding a personal mobility unit along; and at least one part comprising:

a contact surface that generally conforms to the shape of the two or more surface portions of the surface, the contact surface being secured to the surface; and a substantially incompressible body extending from the contact surface and terminating at an exposed surface having a peripheral region and extending outwardly beyond the surface adjacent the peripheral region of the exposed surface, wherein the substantially incompressible body comprises first and second body portions joined by a hinge assembly that comprises first and second hinges, the first hinge is flexibly connected to the first body portion, the second hinge is flexibly connected to the second body portion, and the first and second hinges are flexibly joined.

2. The system of claim 1, wherein the exposed surface comprises a rounded surface, and the system includes a plurality of the parts spaced apart on the surface.

3. The system of claim 1, wherein the exposed surface comprises a surface shaped generally as a partial sphere.

4. The system of claim 1, wherein each of the first and second hinges has a hinge contact surface adapted for attachment to one of the surface portions of the surface.

5. The system of claim 1, wherein the part is permanently secured to the surface.

6. The system of claim 1, wherein the wherein the hinge assembly includes a third hinge located between the first and second hinges.

7. A system for inhibiting sliding along a surface having two or more surface portions oriented at mutually different angles, the system comprising at least one part comprising:

a first body portion;

a first hinge adapted to be flexibly connected to the first body portion;

a second body portion;

a second hinge flexibly connected to the second body portion;

the first hinge and second hinge are flexibly joined; and a contact surface extending over the body portions and the hinges, wherein the part is flexible about the hinges thereby enabling the contact surface to substantially conform to the surface.

8. The system of claim 7, wherein the part is comprised of a unitary piece of plastic.

9. The system of claim 8, wherein the contact surface comprises three dimensional features for providing an increased adhesive contact area relative to a flat contact surface.

10. The system of claim 9, further comprising adhesive located adjacent the contact surface.

11. The system of claim 9, wherein the part is adapted to be permanently adhered to a surface.

12. The system of claim 7, wherein the wherein the hinge assembly includes a third hinge located between the first and second hinges.

* * * * *